US005631801A

United States Patent [19]

DuPuy

[11] Patent Number: 5,631,801

[45] Date of Patent: May 20, 1997

[54] FAST RELAY CONTROL CIRCUIT WITH REDUCED BOUNCE AND LOW POWER CONSUMPTION

[75] Inventor: Robert P. DuPuy, Cherry Hill, N.J.

[73] Assignee: General Electric Company, New York, N.Y.

[21] Appl. No.: 364,965

[22] Filed: Dec. 28, 1994

[51] Int. Cl.[6] ..... H01H 47/10

[52] U.S. Cl. ..... 361/154; 361/155

[58] Field of Search ..... 361/139, 152, 361/154, 155, 156

[56] References Cited

U.S. PATENT DOCUMENTS 3,265,938 8/1966 Daien ..... 361/155

4,777,556 10/1988 Imran ..... 361/155

5,128,825 7/1992 Hurley et al. ..... 361/154

*Primary Examiner*—Fritz Fleming

*Attorney, Agent, or Firm*—William H. Murray; Carl B. Horton

[57] ABSTRACT

A relay control circuit and method for closing a contact in response to an input signal received at a starting time. According to a preferred embodiment of the invention, a rapidly increasing electrical current is applied to the coil during an initial time period beginning at the starting time in response to the input signal, whereby a rapidly increasing force is applied to the contact to move the contact towards a closed position. The electrical current applied to the coil is decreased after the initial time period and maintained above a predetermined minimum magnitude until the contact is closed.

2 Claims, 2 Drawing Sheets

FAST RELAY CONTROL CIRCUIT WITH REDUCED BOUNCE AND LOW POWER CONSUMPTION

BACKGROUND OF THE INVENTION

1. Field of the Invention

The present invention relates to relay circuits, and, in particular, to fast relay circuits with reduced bounce and low power consumption.

2. Description of the Related Art

It is well known to use relay circuits to close output contacts that are electrically isolated from the relay circuit. Referring now to FIG. 1, there is shown a prior art relay circuit 100. As is known to those skilled in the art, a relay circuit contains a relay 101, which comprises inductor coil L having internal resistance $R_L$. When a voltage $V_1$ is applied to relay 101, current $I_1$ passes through inductor L, inducing a magnetic field which forces output contact 120 to close. In this manner, as is well known to those skilled in the art, a voltage $V_1$ applied to relay 101 can close an electrically isolated circuit containing output contact 120.

Relays are often used as protective relays to protect power systems and thus require fast operating times. To force output contact 120 to close more quickly in response to input voltage $V_1$, $V_1$ may be increased and a resistor $R_A$ added in series with relay 101, as shown in FIG. 1. Resistor $R_A$ reduces the amount of input current $I_1$ drawn by relay 101, but the speed of relay 101 is increased because the time constant $L/R=L/(R_L+R_A)$ is decreased. If current $I_1$ is driven by a larger voltage $V_1$, inductor L is energized more quickly so that output contact 120 closes more quickly. If the power delivered by voltage source $V_1$ is doubled, for example, the time required to close output contact 102 is reduced. However, much of the increased power is wasted in resistor $R_A$.

When output contact 120 closes more quickly because the input power is increased, output contact 120 has a greater tendency to bounce since it slams shut with greater force and speed. Thus, in the prior art, relay circuits were speeded up by increasing the power delivered to the circuit, which also increased the tendency of the output contact to bounce. Increased bounce and increased power requirements are undesirable characteristics for many applications.

It is accordingly an object of this invention to overcome the disadvantages and drawbacks of the known art and to provide a relay circuit that more quickly closes an output contact.

It is a further object of this invention to provide such a fast relay circuit that has low power consumption and that also reduces output contact bounce.

Further objects and advantages of this invention will become apparent from the detailed description of a preferred embodiment which follows.

SUMMARY OF THE INVENTION

The previously mentioned objectives are fulfilled with the present invention. There is provided herein a relay control circuit and method for closing a contact in response to an input signal received at a starting time. According to a preferred embodiment of the invention, a rapidly increasing electrical current is applied to the coil during an initial time period beginning at the starting time in response to the input signal, whereby a rapidly increasing force is applied to the contact to move the contact towards a closed position. The electrical current applied to the coil is decreased after the initial time period and maintained above a predetermined minimum magnitude until the contact is closed.

BRIEF DESCRIPTION OF THE DRAWINGS

These and other features, aspects, and advantages of the present invention will become more fully apparent from the following description, appended claims, and accompanying drawings in which:

DESCRIPTION OF THE PREFERRED EMBODIMENT

Figure 2:
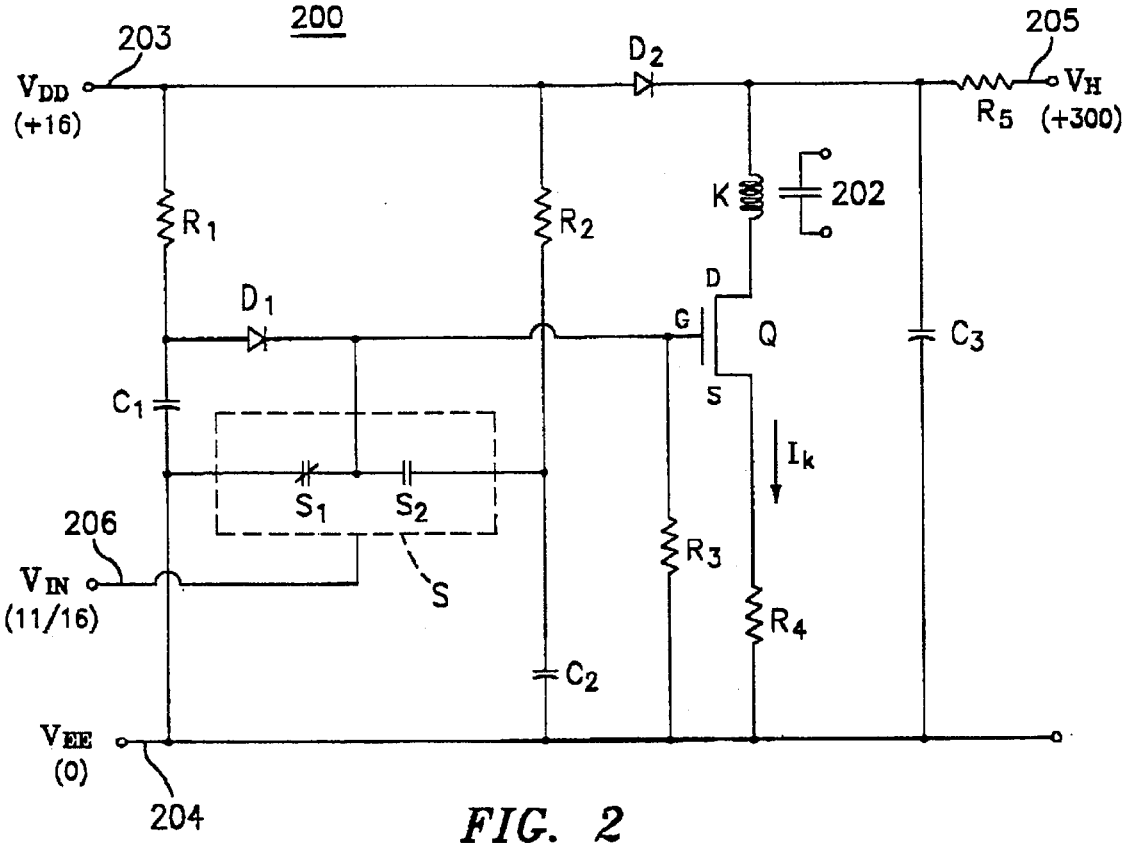
FIG. 2 is a circuit diagram of a relay circuit in accordance with the present invention.

Referring now to FIG. 2, there is shown a circuit diagram of a relay circuit 200 in accordance with the present invention. Relay circuit 200 has a first terminal 203, a second terminal 204, and a third terminal 205 for receiving potentials as described below. Resistor $R_1$ and capacitor $C_1$ are electrically connected in series between first terminal 203 and second terminal 204. In a preferred embodiment, resistor $R_1$ has a resistance of 26.1k Ohms and capacitor $C_1$ has a capacitance of 0.01 μF. A diode $D_1$ is electrically connected at its anode to the junction of the series-connected resistor $R_1$ and capacitor $C_1$, and at its cathode to the gate of a field-effect transistor Q. In a preferred embodiment diode $D_1$ is preferably an IN4148 diode and transistor Q is preferably an IRFU420 MOSFET transistor.

The cathode of $D_1$ is also electrically connected to second terminal 204 through a resistor $R_3$, and to the junction of two switches $S_1$ and $S_2$. The other end of switch $S_1$ is electrically connected to terminal 204 and the other end of switch $S_2$ is electrically connected to the junction of a resistor $R_2$ and capacitor $C_2$, which are connected in series between first terminal 203 and second terminal 204. In a preferred embodiment resistor $R_3$ has a resistance of 15.0k Ohms; resistor $R_2$ has a resistance of 34.0k Ohms; and capacitor $C_2$ has a capacitance of 0.022 μF. Switch S contains switches $S_1$ and $S_2$ and is preferably a single pole, double throw switch such as CMOS analog multiplexer/demultiplexer CD4053B. It will be understood that input terminal 206 is connected to switch S to cause switches $S_1$ and $S_2$ to open and close in accordance with the input signal applied to input terminal 206, as explained below.

A diode $D_2$ is electrically connected at its anode to first terminal 203 and at its cathode to one end of relay coil K. Relay coil K, when energized, causes output contact 202 to close. In a preferred embodiment, relay coil K is a 12-volt relay coil, and diode $D_2$ is preferably an IN5061 diode. The junction of relay coil K and the cathode of diode $D_2$ are electrically connected to a resistor $R_5$ and a capacitor $C_3$. The other end of resistor $R_5$ is electrically connected to third terminal 205 and the other end of capacitor $C_3$ is electrically connected to second terminal 204. In a preferred embodiment, resistor $R_5$ has a resistance of 360k Ohms; and capacitor $C_3$ has a capacitance of 0.22 μF. The other end of relay coil K is electrically connected to the drain of transistor Q, and the source of transistor Q is electrically connected through a resistor $R_4$ to second terminal 204. In a preferred embodiment, resistor $R_4$ has a resistance of 41.2 Ohms.

Relay circuit 200 is connected to a first voltage source $V_{DD}$ at its first terminal 203, to a second voltage source $V_{EE}$ at its second terminal 204, and to a third high voltage source $V_H$ at its third terminal 205. In relay circuit 200 as illustrated, voltage $V_{DD}$ is 16 volts with respect to $V_{EE}$, and $V_H$ is 300 volts with respect to $V_{EE}$. Input signal $V_{IN}$ may be 11 or 16 volts with respect to $V_{EE}$. It will be understood by those skilled in the art that $V_{EE}$ may be referenced to −11 volts rather than to 0 volts, in which case $V_{DD}$ is 5 volts, $V_{IN}$ switches from 0 to 5 volts, and $V_H$ is 289 volts.

In the initial state, output contact 202 is open and relay coil K is de-energized. The input signal $V_{IN}$ is at 11 volts, and has not yet increased to 16 volts to indicate that output contact 202 should be closed. When $V_{IN}$ is at 11 volts, switch $S_1$ is closed and switch $S_2$ is open. Thus capacitor $C_1$ is shorted out through $S_1$ and diode $D_1$ in the initial state and is charged only minimally, i.e. by the amount of the forward voltage drop over diode $D_1$. In the initial state, capacitor $C_2$ has been charged by $V_{DD}$ through resistor $R_2$, and capacitor $C_3$ has been charged by $V_H$ through resistor $R_5$.

When input signal $V_{IN}$ switches from 11 to 16 volts, switch S opens switch $S_1$ and closes switch $S_2$. The voltage $V_G$ of $C_2$ drives the gate of transistor Q, and the high voltage of $C_3$ causes current $I_K$ to increase at a very rapid rate through relay coil K. The current $I_K$ flowing through relay coil K is initially limited primarily by the inductance of relay coil K, since transistor Q is initially full on. After the initial period, transistor Q, which is driven by $V_G$ less the voltage drop $V_{G-S}$ of transistor Q and the voltage drop across $R_4$, begins to limit current $I_K$. As $C_2$ discharges through $R_3$, $V_G$ decreases and thus the current $I_K$ is increasingly limited by Q.

Figure 3:
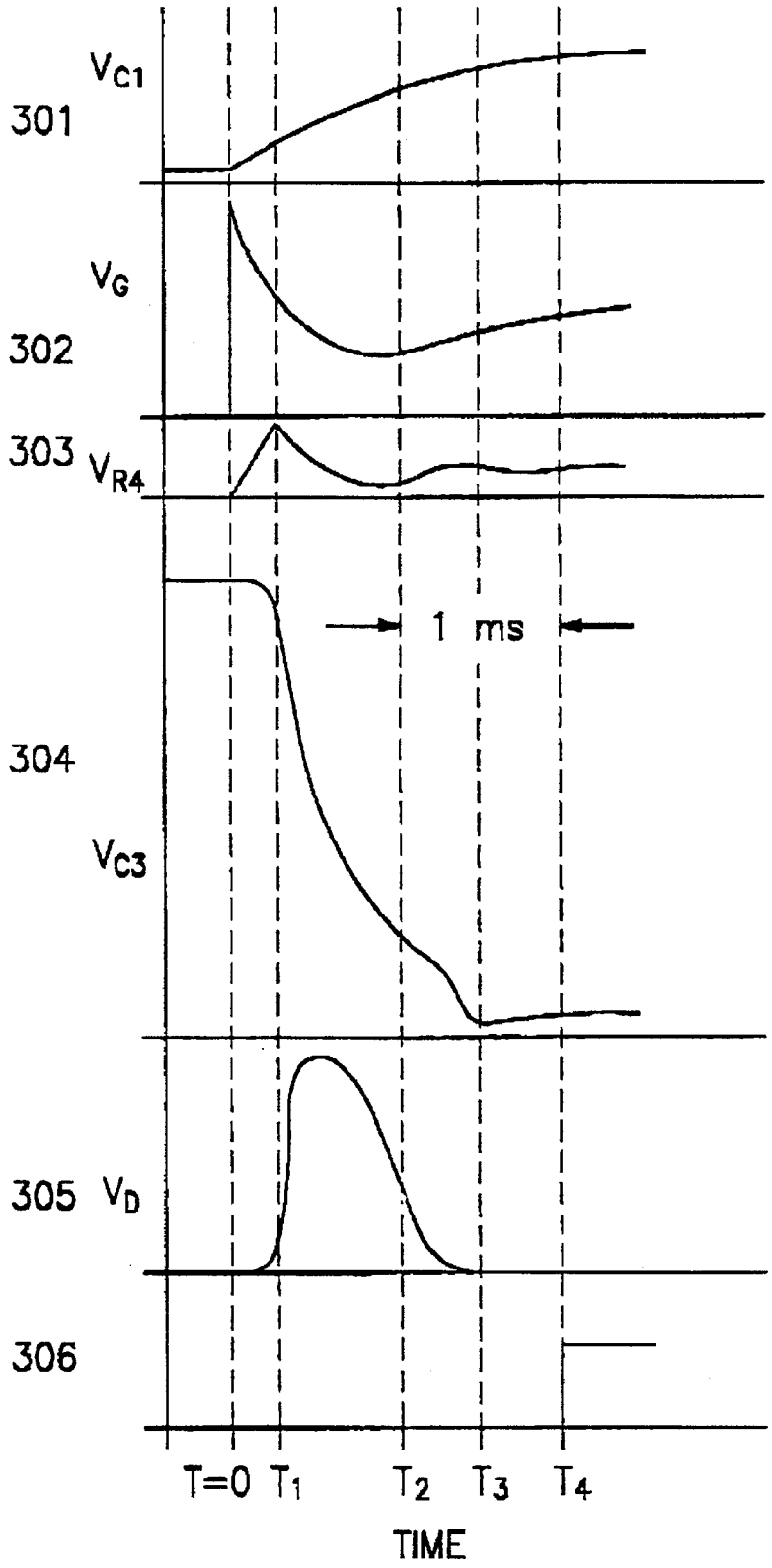
FIG. 3 depicts selected voltages of the relay circuit of FIG. 2 plotted versus time to illustrate the operation of said relay circuit.

Referring now to FIG. 3, there are depicted several voltages of relay circuit 200 plotted versus time to illustrate the operation of relay circuit 200 (not necessarily to scale). These magnitudes were measured during tests of the test circuit configured as shown in FIG. 2. As shown in graph 302, when input signal $V_{IN}$ is applied at time T=0 (by increasing $V_{IN}$ from 11 to 16 volts), voltage $V_G$, driven by the voltage of $C_2$, is at a maximum and begins to decrease as $C_2$ discharges through $R_3$. During this initial time period (i.e. until approximately time $T_1$) capacitor $C_3$ discharges rapidly (graph 304 of FIG. 3), and the current $I_k$ driven thereby is initially limited by the inductance of relay coil K, since transistor Q is initially full on.

Initially, because of the rapid discharge of $C_3$ which energizes relay coil K and because of the higher initial voltage of $V_G$ which allows Q to be full on to conduct current $I_K$, current $I_K$ rises rapidly. As current $I_K$ rises rapidly within and thus energizes relay coil K, a force is correspondingly exerted on output contact 202 to move it towards the closed position. In this manner output contact 202 is very rapidly accelerated. As will be appreciated by those skilled in the art, voltage $V_{R4}$ across resistor $R_4$ is proportional to current $I_K$ by the relationship $V_{R4}=I_K*R_4$. AS can be seen in the graph of $V_{R4}$ in graph 303 of FIG. 3, current $I_K$ rises rapidly from time T=0 to time $T_1$, and decays until $T_2$.

It will be appreciated that $C_2$ discharges through $R_3$, causing $V_G$ to decay (graph 302 of FIG. 3), so that transistor Q increasingly resists or limits the flow of current $I_K$ from $T_1$ to $T_2$. Therefore, because $V_G$ decays from $T_1$ to $T_2$ (graph 302 of FIG. 3), less current $I_K$ is driven through relay coil K, transistor Q, and resistor $R_4$. In this manner, after the initial period in which $I_K$ very rapidly rises (along with $V_{R4}$, graph 303 of FIG. 3), $I_K$ begins to decrease at time $T_1$ from its peak magnitude at $T_1$.

Thus, during the time from T=0 to approximately $T_1$ current $I_K$ has increased rapidly to rapidly begin to exert a large force on output contact 202 so that it will to close very rapidly. However, after $T_1$, current $I_K$ will need to begin to decrease to decrease the force imparted on output contact 202, otherwise output contact 202 will continue to accelerate and will close at too high a speed, which may result in contact bounce upon closure. Therefore, after time $T_1$, current $I_K$ begins to decrease. Those skilled in the art will understand that the force exerted on output contact 202 by current $I_K$ flowing through relay coil K causes output contact 202 to accelerate. Even after time $T_1$, when current $I_k$ is decreasing, current $I_K$ still causes a force to be exerted on output contact 202.

At approximately time $T_2$, $I_K$ will have decreased to approximately a steady rate at which current $I_K$ can bring output contact 202 to closure with reduced bounce but with enough force to hold output contact 202 closed at time $T_4$. Thus, relay circuit 200 is configured so that current $I_K$ will stop decreasing at approximately time $T_2$ and will recover and maintain a steadier and relatively smaller current $I_K$ through relay coil K thereafter. In this manner, output contact 202 has a very large force imparted upon it initially to begin to accelerate it very quickly. The force, which is proportional to $I_k$, decreases steadily and reaches a substantially constant value, to minimize bounce when output contact 202 closes at time $T_4$ and also to exert a motivational force to ensure that output contact 202 reaches and maintains the closed position. Relay circuit 200 accomplishes this in the following described manner.

While $C_2$ is discharging (from T=0), $V_{DD}$ is charging capacitor $C_1$ through resistor $R_1$ beginning at T=0. Thus, $V_{C1}$ rises as shown in graph 301 of FIG. 3 while $V_{C2}$ falls. When $V_{C1}$ rises to a voltage greater than decreasing voltage $V_{C2}$ plus the forward voltage drop across diode $D_1$, $V_{C1}$ takes over control of the voltage $V_G$ that regulates transistor Q's conductance of current $I_K$. Thus, at approximately $T_2$, as shown in graph 302, $V_G$ begins to rise once more, so that transistor Q increasingly conducts current $I_K$, i.e. limits $I_K$ less and less as $V_G$ steadily increases.

After $C_3$ discharges to the point where $V_{DD}$ is greater than $V_{C3}$ plus the forward voltage drop across diode $D_2$, $V_{DD}$ powers relay coil K so that relay coil is still being energized even after $C_3$ discharges. Therefore, although $C_3$ is nearly depleted at time $T_3$ (graph 304), at approximately time $T_3$ voltage $V_{DD}$ begins to power relay coil K rather than the decreasing charge from $C_3$, as indicated by graph 304. In graph 304, at approximately time $T_3$, $V_{C3}$ stops decreasing and flattens out. This occurs because, as will be appreciated by those skilled in the art, when $V_{DD}>V_{C3}+V_{D2}$, diode $D_2$ is turned on and the voltage across $C_3$ cannot fall below $V_{DD}-V_{D2}$. Therefore, $V_{C3}$ decreases steadily as capacitor $C_3$ discharges, until $V_{DD}>V_{C3}+V_{D2}$, at which point $V_{C3}$ remains at the constant voltage $V_{DD}-V_{D2}$.

Thus, after $T_2$, since $V_G$ rises after $T_2$ (graph 302) so that transistor Q decreasingly resists $I_K$ (i.e. increasingly conducts $I_K$), and since the constant voltage $V_{DD-VD2}$ drives current $I_K$ through relay coil K, a substantially constant current $I_K$ continues to flow through relay coil K after time $T_2$ (graph 303) so that output contact 202 is still motivated to continue closing until it actually closes at time $T_4$. As those skilled in the art will appreciate, diode $D_2$ is used to block the high voltage $V_{C3}$ and from $V_H$ from voltage $V_{DD}$, and $R_5$ is selected as a high resistance to keep power loss at a minimum.

In this manner, at time $T_4$ output contact 202 closes, as shown in graph 306 of FIG. 3. Output contact 202 closes in a shorter time than in the prior art because of the initially high energizing of relay coil K caused by the very rapid increase in current $I_K$, as shown in graph 303 of FIG. 3. Output contact 202 closes with reduced bounce even though it is initially accelerated at a very high rate, because current $I_K$ is reduced after its initial increase to allow output contact 202 to close at a slower speed and with less force than it has when initially being accelerated. Relay circuit 200 therefore comprises a means for applying a rapidly increasing electrical current $I_K$ to coil K during an initial time period beginning at a starting time T=0 until approximately $T_1$ in response to an input signal, whereby a rapidly increasing force is applied to output contact 202 to move contact 202 towards a closed position; and also comprises a means for decreasing the electrical current $I_K$ after the initial time period, and means for maintaining electrical current $I_K$ above a predetermined minimum magnitude after approximately time $T_3$ until the contact is closed.

Figure 1:
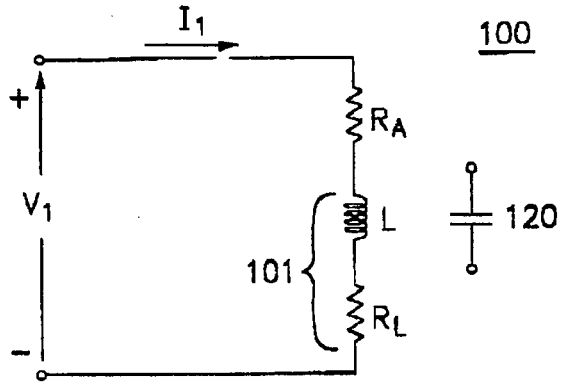
FIG. 1 (PRIOR ART)
FIG. 1 is a circuit diagram of a prior art relay circuit.

In the test circuit configured as shown in FIG. 2, the speed of closure of output contact 202 was improved typically from 0.0045 to 0.0022 seconds over prior art circuits such as circuit 100 shown in FIG. 1. Further, in part because relay circuit 200 does not waste a large amount of power on a resistor such as $R_A$ of prior art circuit 100 of FIG. 1, less overall power is needed to drive relay coil K than in prior art circuit 100. Additionally, because relay circuit 200 decreases the current $I_K$ energizing relay coil K after its initial rapid increase and before output contact 202 closes, output contact 202 closes at time $T_4$ with a lower speed and force than it has initially (e.g., at times $T_1$ and $T_2$), thereby minimizing the bounce of output contact 202 when it closes at time $T_4$.

It will be understood by those skilled in the art that in alternative preferred embodiments times $T_2$ and $T_3$ might occur roughly simultaneously, or $T_3$ might occur prior to $T_2$. For instance, if $C_3$ discharged slightly more quickly and/or $C_2$ discharged slightly more slowly, as might be desired for varying applications or for relay coils with different characteristics, then $T_3$ might occur before $T_2$. In this case during the time from $T_2$ until $T_4$ current $I_K$ would still flow through relay coil K at a fairly uniform rate though relatively lower than during the initial rapid-acceleration period, and thus output contact 202 would still have time to slow down from its initial high speed to minimize bounce upon closure and would still be motivated towards closure by relay coil K.

It will be understood that various changes in the details, materials, and arrangements of the parts and features which have been described and illustrated above in order to explain the nature of this invention may be made by those skilled in the art without departing from the principle and scope of the invention as recited in the following claims.

What is claimed is:

1. A relay control circuit for controlling the closure of a coil-operated relay contact in response to an input signal applied to the relay control circuit at a starting time, the relay control circuit comprising:

(a) means for applying a rapidly increasing electrical current to the coil during an initial time period beginning at the starting time in response to the input signal, whereby a rapidly increasing force is applied to the contact to move the contact towards a closed position; means (a) comprising:

(1) a charging capacitor for supplying an initially large energizing potential to the coil during the initial time period, wherein the coil is for applying a force to the contact to move the contact towards the closed position in response to the electrical current conducted therethrough;

(2) means for resisting or conducting the electrical current in response to a control potential; wherein the control potential is applied to a third terminal of the means for resisting or conducting the electrical current and the means for resisting or conducting the electrical current has first and second terminals and is coupled at its first terminal to the coil; and (3) means for regulating the control potential so that means (a)(2) does not resist the electrical current during the initial time period;

(b) means for decreasing the electrical current applied to the coil after the initial time period and means for maintaining the electrical current above a predetermined minimum magnitude until the contact is closed; means (b) comprising;

(1) the means for resisting or conducting the electrical current in response to the control potential;

(2) means for regulating the control potential so that the means for resisting or conducting the electrical current increasingly resists the electrical current after the initial time period until the electrical current reaches the predetermined minimum magnitude;

(3) means for regulating the control potential so that the means for resisting or conducting the electrical current increasingly conducts the electrical current after the electrical current reaches the predetermined minimum magnitude;

(4) means for decreasing the energizing potential supplied to the coil after the initial time period until the energizing potential reaches a predetermined minimum potential magnitude; and (5) means for maintaining the energizing potential above the predetermined minimum potential magnitude until the contact is closed;

(c) an input terminal for receiving the input signal;

(d) means for applying means (b)(2) to the third terminal of the means for resisting or conducting the electrical current at the starting time in response to the input signal; and (e) means for removing means (b)(2) from the third terminal of the means for resisting or conducting the electrical current when the electrical current reaches the predetermined minimum magnitude and for applying means (b)(3) to the third terminal of the means for resisting or conducting the electrical current when the electrical current reaches the predetermined minimum magnitude;

wherein:

the means for resisting or conducting the electrical current comprises a field-effect transistor, wherein the second terminal of the transistor is coupled to a second power-supply terminal through a fourth resistor;

means (d) comprises a second switch coupled to the third terminal of the transistor and to the input terminal and is configured to close when the input signal is received at the starting time;

means (b)(2) comprises a second capacitor and a third resistor, wherein the second capacitor is coupled at its first end through the second switch to the first end of the third resistor and to the third terminal of the transistor, and the second end of the second capacitor and the second end of the third resistor are coupled to the second power-supply terminal, further wherein the second capacitor is coupled at its first end through a second resistor to a first power-supply terminal;

means (b)(3) comprises a first resistor, a first capacitor, a first diode, and a first switch, wherein the first end of the first capacitor and the anode of the first diode are coupled to the first power-supply terminal through the first resistor, the second end of the first capacitor is coupled to the second power-supply terminal, and the cathode of the first diode is coupled to the third terminal of the transistor and through the first switch to the second end of the first capacitor and to the second power-supply terminal, wherein the first switch is coupled to the input terminal and is configured to open when the input signal is received at the starting time;

means (b)(4) comprises the charging capacitor, wherein the charging capacitor is coupled at its first end to the second power-supply terminal, and at its second end to the first end of the coil and through a fifth resistor to a third power-supply terminal; and means (b)(5) comprises a second diode coupled at its anode to the first power-supply terminal and at its second end to the first end of the coil.

2. A relay control circuit for controlling the closure of a coil-operated relay contact in response to an input signal applied to the relay control circuit at a starting time, the relay control circuit comprising:

(a) first, second, and third power-supply terminals;

(b) an input terminal for receiving the input signal, wherein the coil is configured to move the contact towards a closed position in response to an energizing electrical current driven by an energizing potential;

(c) a field-effect transistor for resisting or conducting the electrical current in response to a control potential applied to a third terminal of the transistor, wherein the transistor has first and second terminals and is coupled at its first terminal to the coil, and the second terminal of the transistor is coupled to the second power-supply terminal through a fourth resistor;

(d) a second capacitor coupled at its first end through a second switch to the first end of a third resistor and to the third terminal of the transistor, wherein the second end of the second capacitor and the second end of the third resistor are coupled to the second power-supply terminal, and the second capacitor is coupled at its first end through a second resistor to the first power-supply terminal, wherein the second switch is coupled to the input terminal and is configured to close in response to the input signal;

(e) a first capacitor coupled at its first end to the anode of a first diode and through a first resistor to the first power-supply terminal, the first capacitor coupled at its second end to the second power-supply terminal, wherein the cathode of the first diode is coupled to the third terminal of the transistor and through a first switch to the second end of the first capacitor, wherein the first switch is coupled to the input terminal and is configured to open in response to the input signal;

(f) a third capacitor coupled at its first end to the second power-supply terminal, and at its second end to the first end of the coil and through a fifth resistor to the third power-supply terminal; and (g) a second diode coupled at its anode to the first power-supply terminal and at its cathode to the first end of the coil.

* * * * *